United States Patent [19]

Bonar

[11] Patent Number: 4,823,948

[45] Date of Patent: Apr. 25, 1989

[54] PREASSEMBLED SEW-READY BUTTON

[76] Inventor: George D. Bonar, 333 Bowery, New York, N.Y. 10003

[21] Appl. No.: 101,804

[22] Filed: Sep. 28, 1987

[51] Int. Cl.[4] ..... B65D 69/00

[52] U.S. Cl. ..... 206/227; 57/243; 57/348

[58] Field of Search ..... 206/227, 348, 872, 574, 206/582, 820; D9/303; 2/265; 223/106, 107, 109 R; 57/243, 903

[56] References Cited

U.S. PATENT DOCUMENTS

| | | | |
|---|---|---|---|
| D. 176,148 | 11/1955 | Krutt | D9/303 |
| 1,733,825 | 10/1929 | Rosenthal | 206/514 |
| 1,954,616 | 4/1934 | Collingbourne | 206/227 |
| 2,109,319 | 2/1938 | Lichter | 206/227 |
| 3,180,487 | 4/1965 | Uddenborg | 206/227 |
| 3,368,343 | 2/1968 | Crook et al. | 57/243 |
| 3,603,492 | 9/1971 | Schantz | 206/227 |
| 3,857,484 | 12/1974 | Thyen | 206/227 |
| 4,032,012 | 6/1977 | Bishop | 206/574 |

FOREIGN PATENT DOCUMENTS

| | | | |
|---|---|---|---|
| 140152 | 10/1949 | Australia | 206/348 |
| 827583 | 1/1952 | Fed. Rep. of Germany | 206/227 |
| 1053488 | 9/1953 | France | 206/227 |
| 2504564 | 4/1981 | France | 206/574 |

*Primary Examiner*—Joseph Man-Fu Moy

[57] ABSTRACT

A new combination of an integrally-formed button, thread, and needle to eliminate the need for assembling these items. In the present invention, they are preassembled and ready for immediate use by the sewer.

13 Claims, 1 Drawing Sheet

PREASSEMBLED SEW-READY BUTTON

FIELD OF THE INVENTION

This invention relates to a preassembled sew-ready button combining the needle, thread, and button preassembled in one unit. This is a continuation of application Ser. No. 665,539 filed on Mar. 4, 1985, now abandoned.

BACKGROUND OF THE INVENTION

In the past, in order for someone to sew on a button, they must purchase separately not only the button, but the needle and thread. Typically, one has to purchase these items in quantities, such as a package of several buttons and/or needles or a spool of thread that contains many feet of thread, all of which makes it unduly expensive when only one or two buttons have to be sewn.

Typically, one spends a great deal of time in purchasing, collecting, and then assembling the appropriate needle and the desired color and type of thread and button.

This whole procedure becomes even more burdensome to the elderly or infirmed who may have great difficulty in even threading a needle.

Although the prior art discloses the use of packages and/or kits which include separated buttons, needles, and/or threads, they do not solve all of the drawbacks discussed above. For example, U.S. Pat. No. 1,733,825 to Rosenthal discloses the use of a garment repair kit which has needles, threads, buttons, spot cleaner, and fabric mender as individual items within the kit. U.S. Pat. No. 2,109,318 to Lichter demonstrates a mending kit that contains separate needles, safety pins, buttons, and different colored windings of thread. Also, West German Pat. No. 827,538 to Fallier shows the use of a sewing kit that contains different sized buttons, safety pins, needles, and thread, as separate items therein. In particular, in describing FIG. 3, Fallier specifically states that the buttons and needles lie loose next to each other. In French Pat. No. 2,504,564 to Weill and U.S. Pat. No. 4,032,012 to Bishop, both demonstrate the preattachment of a piece of thread to a needle which is part of a sewing or mending kit.

Accordingly, the prior art fails to disclose an arrangement in which all of the components necessary to sew a button are preassembled.

SUMMARY OF THE INVENTION

In accordance with the present invention, there is provided a self-contained package, consisting of a preassembled needle, thread, and button which are integrally attached to each other.

The advantages of the present invention are that it minimizes the expenses and time required for various sewing chores. The present invention saves a considerable amount of time, as there is no need to purchase the individual packets of needles or buttons or packages of different colored spools of thread.

This invention avoids the need for assembling the components necessary for sewing, since the needle, thread, and button are preattached to each other. As there is only one needle, several inches of thread and one button per package, this self-contained sewing kit is inexpensive, easy to use, and saves time.

This present invention is quite convenient to the elderly or infirmed or young children, as this sewing kit is ready for immediate use, since the infirmed, young children, or elderly have no need to even thread a needle.

BRIEF DESCRIPTION OF THE DRAWINGS

Further objects and advantages of the invention will become apparent from the following description and claims and from the accompanying drawings, wherein:

DETAILED DESCRIPTION OF THE PREFERRED EMBODIMENTS

Figure 1:
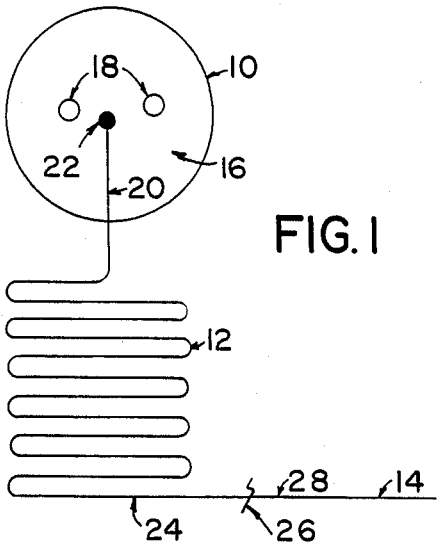
FIG. 1 is a top plan view of the preassembled button, thread, and needle, with the thread in a zig-zag pattern.
Figure 2:
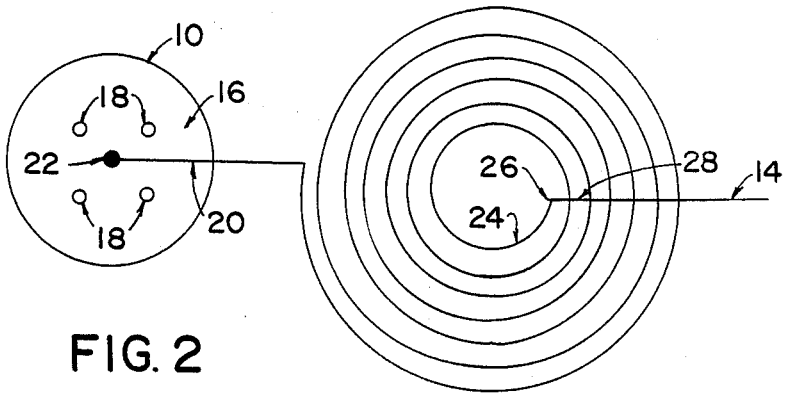
FIG. 2 is a top plan view of the preassembled button, thread, and needle, with the thread in a circular pattern.

Referring now in detail to the drawings, like numerals indicate like elements throughout both FIGS. 1 and 2. The present invention, as shown in FIGS. 1 and 2, demonstrates the preassembled sewing kit that consists of a button 10, a length of thread 12, and a needle 14.

Button 10 has a back surface 16 with button holes 18 formed therein in a conventional manner. Button 10 is fixedly attached to the first end 20 of thread 12 in a permanent manner by such means as glue 22 or other suitable bonding materials, such as epoxy cement, epoxy paint, etc., and/or bonding methods. The glue 22 can be applied automatically in droplet form to the first end 20 of thread 12 and back surface 16 of button 10 and allowed to dry. This forms a permanent bond between the back surface 16 of button 10 and the first end 20 of thread 12. Of course, the glue 22 or other bonding materials can be applied to the button 10 and thread 12 in any other suitable manner.

Alternative methods of fixedly connecting button 10 to thread 12 are also encompassed within the scope of this invention. For example, thread 12 can be heat sealed at 22 to the back surface 16 of button 10, since thread 12 is made of plastic-like materials, such as nylon, dacron, polyester, etc., which are capable of being melted and heat sealed into the button 10.

Another method of fixedly connecting button 10 to thread 12 is by fusion, where a droplet of material 22, similar to the button composition, is heated and fused to the thread end 20 and to the back surface 16 of button 10.

Another method of fixedly connecting button 10 to thread 12 is by the use of a small piece of an adhesive tape material 22 which is used to adhere thread end 20 to the back surface 16 of button 10.

Needle 14 is made of conventional plastic-like materials or conventional metallic materials or made by the hardening of thread 12 by lamination, fusion, or bonding wherein the material added to the thread forms it into a needle implement.

In the embodiment where needle 14, whether it be made of plastic or metal, is fixedly connected to the second end 24 of thread 12, this is accomplished in a permanent manner by such means as glue 26 or other suitable bonding materials, such as epoxy cement, epoxy paint, etc., and/or bonding methods. The glue 26 can be applied automatically in droplet form to the second end 24 of thread 12 and inner end 28 of needle 14 and then allowed to dry. This forms a permanent bond between the needle 14 and the second end 24 of thread 12. Of course, the glue 26 or other bonding materials can be applied to the needle 14 and thread 12 in any other suitable manner that would provide a permanent attachment.

Alternate methods of fixedly connecting needle 14 to thread 12 are also encompassed within the scope of this present invention. For example, thread 12 can be heat sealed at 26 to the inner end 28 of needle 14, since thread 12 is made of plastic-like materials, such as nylon, dacron, polyester, etc., which are capable of being melted and heat sealed on needle 14 also made of plastic-like materials, such as polyvinylchloride, polyethylene, and/or polypropylene, etc.

Another method of fixedly connecting needle 14 to thread 12 is by fusion, where a droplet of material similar to the needle composition is heated and is used to fuse the thread end 24 to the inner end 28 of needle 14.

Needle 14 can also be formed by hardening the second end 24 of thread 12 into a stiff non-flexible rod with epoxy resin materials or other suitable bonding, coating, or lamination materials. This can be accomplished by a number of different methods, such as dipping of thread end 24 into a liquified bath of epoxy cement or glue; or by coating of thread end 24 with epoxy cement or glue; or by the bonding of epoxy resin materials on thread end 24 in a continuous heated mold extruder or by the lamination of PVC, etc., material on thread end 24. This rod can then be cut or sharpened into a needle point, thereby eliminating the need of fixedly attaching a separate plastic or metallic needle, as mentioned in the above embodiments.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. The combination of a button, a length of thread having a first end fixedly connected to one surface of said button, and a needle fixedly connected to the second end of said thread remote from said button, wherein said first end of thread is fixedly connected to one surface of said button by means of glue or epoxy cement or epoxy paint or other suitable bonding material.

2. The combination of a button, a length of thread having a first end fixedly connected to one surface of said button, and a needle formed on the second end of said thread remote from said button, wherein said first end of thread is fixedly connected to one surface of said button by means of glue or epoxy cement or epoxy paint or other suitable bonding material.

3. The combination of a button, a length of thread having a first end fixedly connected to one surface of said button, and a needle fixedly connected to the surface end of said thread remote from said button, wherein said first end of thread is fixedly connected to one surface of said button by means of heat sealing.

4. The combination of a button, a length of thread having a first end fixedly connected to one surface of said button, and a needle formed on the second end of said thread remote from said button, wherein said first end of thread is fixedly connected to one surface of said button by means of heat sealing.

5. The combination of a button, a length of thread having a first end fixedly connected to one surface of said button, and a needle fixedly connected to the second end of said thread remote from said button, wherein said first end of thread is fixedly connected to one surface of said button by using a small piece of adhesive tape.

6. The combination of a button, a length of thread having a first end fixedly connected to one surface of said button, and a needle formed on the second end of said thread remote from said button, wherein said first end of thread is fixedly connected to one surface of said button by using a small piece of adhesive tape.

7. The combination of a button, a length of thread having a first end fixedly connected to one surface of said button, and a needle fixedly connected to the second end of said thread remote from said button, wherein the second end of said thread is fixedly connected to the inner end of said needle by means of glue or epoxy cement or epoxy paint or other suitable bonding materials.

8. The combination of a button, a length of thread having a first end fixedly connected to one surface of said button, and a needle fixedly connected to the second end of said thread remote from said button, wherein the second end of said thread is fixedly connected to the inner end of said plastic needle by means of heat sealing.

9. The combination of a button, a length of thread having a first end fixedly connected to one surface of said button, and a needle fixedly connected to the second end of said thread remote from said button, wherein the second end of said thread is fixedly connected to the inner end of said needle by means of fusion.

10. The combination of a button, a length of thread having a first end fixedly connected to one surface of said button, and a needle formed on the second end of said thread remote from said button, wherein the second end of said thread is hardened to form said needle.

11. The combination of a button, a length of thread having a first end fixedly connected to one surface of said button, and a needle formed on the second end of said thread remote from said button, wherein the second end of said thread is hardened to form said needle by applying epoxy cement or glue thereto.

12. The combination of a button, a length of thread having a first end fixedly connected to one surface of said button, and a needle formed on the second end of said thread remote from said button, wherein the second end of said thread is hardened to form said needle applying bonding materials, such as epoxy resins thereto.

13. The combination of a button, a length of thread having a first end fixedly connected to one surface of said button, and a needle formed on the second end of said thread remote from said button, wherein the second end of said thread is hardened to form said needle by lamination of PVC, polyethylene, or polypropylene thereto.

* * * * *